US005429882A

United States Patent [19]

Carey, II et al.

[11] Patent Number: 5,429,882

[45] Date of Patent: * Jul. 4, 1995

[54] BUILDING MATERIAL COATING

[75] Inventors: Jay F. Carey, II, Follansbee, W. Va.; Mehrooz Zamanzadeh, Pittsburgh, Pa.

[73] Assignee: The Louis Berkman Company, Steubenville, Ohio

[ * ] Notice: The portion of the term of this patent subsequent to Mar. 28, 2012 has been disclaimed.

[21] Appl. No.: 260,333

[22] Filed: Jun. 15, 1994

Related U.S. Application Data

[63] Continuation-in-part of Ser. No. 209,400, Mar. 10, 1994, which is a continuation-in-part of Ser. No. 175,523, Dec. 30, 1993, Pat. No. 5,401,586, which is a continuation-in-part of Ser. No. 154,376, Nov. 17, 1993, abandoned, which is a continuation of Ser. No. 42,649, Apr. 5, 1993, abandoned.

[51] Int. Cl.[6] ..... B32B 15/18; B32B 15/20

[52] U.S. Cl. ..... 428/647; 428/648; 428/658; 428/659; 428/939

[58] Field of Search ..... 428/659, 685, 658, 935, 428/939, 646, 647, 648, 650, 674, 679; 148/242; 427/433

[56] References Cited

U.S. PATENT DOCUMENTS

| | | | |
|---|---|---|---|
| 84,205 | 11/1868 | Mills | 428/648 |
| 1,856,169 | 10/1915 | Monnot | 428/658 |
| 1,989,925 | 2/1935 | Hoover | 148/6 |
| 2,258,327 | 10/1941 | Kramer | 29/181 |
| 2,703,766 | 3/1955 | Ellis | 117/114 |
| 3,012,310 | 12/1961 | Godfrey | 29/196.4 |
| 3,231,127 | 1/1966 | Virzi | 220/52 |
| 3,630,792 | 12/1971 | Smyth | 148/6.3 |
| 3,791,801 | 2/1974 | Ariga et al. | 29/196.5 |
| 3,962,501 | 6/1976 | Ohbu et al. | 427/433 |
| 3,966,564 | 6/1976 | Hyner et al. | 204/43 |
| 4,049,481 | 9/1977 | Morisaki | 156/151 |
| 4,184,928 | 1/1980 | Hoije | 204/43 |
| 4,190,504 | 2/1980 | Usui | 204/35 |
| 4,321,289 | 3/1982 | Bartsch | 427/287 |
| 4,814,049 | 3/1989 | Helton et al. | 204/44.2 |
| 4,969,980 | 11/1990 | Yoshioka et al. | 204/28 |
| 4,999,258 | 3/1991 | Wake et al. | 428/659 |
| 5,114,799 | 5/1992 | Ohashi et al. | 428/659 |
| 5,203,985 | 4/1993 | Nishimura et al. | 205/193 |

FOREIGN PATENT DOCUMENTS

| | | | |
|---|---|---|---|
| 58-48694 | 3/1983 | Japan | 428/659 |
| 59-41430 | 3/1984 | Japan | 420/557 |
| 59-96238 | 6/1984 | Japan | 420/557 |
| 546179 | 1/1942 | United Kingdom | 420/557 |
| 796128 | 6/1958 | United Kingdom . | |
| 1008316 | 10/1965 | United Kingdom . | |
| 1513002 | 6/1978 | United Kingdom | C23C 1/06 |
| 1517454 | 7/1978 | United Kingdom . | |
| 1588808 | 4/1981 | United Kingdom | C22C 18/00 |
| 2099857 | 12/1982 | United Kingdom | C23C 1/02 |
| 2117414 | 10/1983 | United Kingdom | C23C 1/06 |

OTHER PUBLICATIONS

Higuchi et al., "Sn-Zn Alloy Electroplated Steel Sheet for Container of Alcohol Fuel or Alchohol-Containing Fuel", Translation of Japanese Kokai 58-48694, Mar. 1983, 11 pages.

(List continued on next page.)

*Primary Examiner*—John Zimmerman

*Attorney, Agent, or Firm*—Vickers, Daniels & Young

[57] ABSTRACT

A corrosion-resistant colored architectural material which is essentially lead free and is not highly reflective. The coating on the material is a two-phase metallic coating comprised of a large weight percentage of zinc and a relatively large weight percentage of tin. The tin-zinc coating may also include nickel and copper. The tin-zinc composition provides for both a highly corrosive-resistant coating which protects the surface of the architectural material from oxidation and also produces a gray, earth tone colored which is not highly reflective.

37 Claims, No Drawings

OTHER PUBLICATIONS

Federal Specification QQ-T-201F, 12 Nov. 1986, "Terneplate, for Roofing and Roofing Products", pp. 1-8.

"Hot Dip Tin Coating of Steel and Cast Iron", Metals Handbook, 9th ed., vol. 5, 1983, pp. 351-355, no month.

Galiumzing, p. 1322, Van Nostrands Scientific Encyclopedia, Sixth Edition, no date.

Metal Coatings, p. 35, McGraw-Hill Encyclopedia of Scient. & Technology, 6th Edition vol. II, no date.

Robert J. Nekervis et al., Tinning of Steel, pp. 709-712, American Society for Metals-Metals Handbook, no date.

W. M. Peirce, Zinc Coatings, pp. 712-714, American Society for Metals-Metals Handbook, no date.

Erwin Vogelsang et al., Tin & Tin Alloys, pp. 1063-1070, American Society for Metals-Metals Handbook, no date.

R. K. Waring et al., Zinc & Zinc Alloys, pp. 1077-1086, American Society for Metals-Metals Handbook, no date.

Materials & Methods, "Tin-Zinc Alloy Coatings" (from Tin, Jul. 1946, pp. 9-10) pp. 1248, 1250.

BUILDING MATERIAL COATING

This application is a continuation-in-part of prior application Ser. No. 209,400 filed Mar. 10, 1994 which in turn is a continuation-in-part of application Ser. No. 175,523, now U.S. Pat. No. 5,401,586, filed Dec. 30, 1993, which in turn is a continuation-in-part of application Ser. No. 154,376 filed Nov. 17, 1993, now abandoned, which in turn is a continuation of application Ser. No. 042,649 filed Apr. 5, 1993, now abandoned.

The present invention relates to the art of metal architectural materials and more particularly to an architectural sheet material that is environmentally friendly while providing long life and desired colorization.

INCORPORATION BY REFERENCE

As background material, so that the specification need not specify in detail what is known in the art, Assignees' U.S. Patents 4,987,716 and 4,934,120 illustrate metal roofing systems of the type to which this invention can be used and are incorporated herein by reference. U.S. patent application Ser. No. 000,101 filed Jan. 4, 1993, illustrating a process of hot-dip coating roofing materials, is also incorporated herein by reference.

The present invention relates to the art of coating a metal sheet material and more particularly to the coating of a sheet of steel material with a hot-dipped coating of zinc and tin; however, the invention has much broader applications.

BACKGROUND OF THE INVENTION

Over the years, architectural materials, such as metal roofing systems and metal siding systems, made of pliable metals in various sheet gauge thicknesses have been used. Metals such as carbon steel, stainless steel, copper and aluminum are the most popular types of metal. These architectural metal materials are commonly treated with corrosion-resistant coatings to prevent rapid oxidation of the metal surface, thereby extending the life of the materials. A popular corrosion-resistant coating for carbon steel and stainless steel is a terne coating. Terne coating has been the predominate and most popular coating for roofing materials due to its relatively low cost, ease of application, excellent corrosion-resistant properties and desirable colorization during weathering. The terne coating is an alloy typically containing about 80% lead and the remainder tin. The coating is generally applied to the architectural materials by a hot-dip process wherein the material is immersed into a molten bath of terne metal. Although terne coated sheet metals have exhibited excellent resistant properties and have been used in a variety of applications, the terne coating has been questioned in relation to its impact on the environment. Environmental and public safety laws have been recently proposed and/or passed prohibiting the use of materials containing lead. Because the terne alloy contains a very high percentage of lead, materials coated with terne have been prohibited in various types of usages or applications such as aquifer roofing systems. The concern of lead possibly leaching from the terne coating has made such coated materials inadequate and/or undesirable for several types of building applications. The terne alloy has a further disadvantage in that the newly applied terne is very shiny and highly reflective. As a result, the highly-reflective coating cannot be used on buildings or roofing systems such as at airports and military establishments. The terne coating eventually loses its highly-reflective properties as the components within the terne coating are reduced (weathered); however, the desired amount of reduction takes approximately ½ to 2 years when the terne coating is exposed to the atmosphere, thus requiring the terne metals to be stored over long periods of time prior to being used in these special areas. The storage time is significantly prolonged if the terne-coated materials are stored in rolls and the rolls are protected from the atmosphere. However, once the terne has properly weathered, the color of the weathered coating is a very popular grey-earth tone color.

Tin coating of carbon steel is a well-known process for use in the food industry. However, in the specialized art of architectural materials, a tin coating for architectural materials has not been used until done by the present inventors. The most popular process for applying a tin coating to carbon steel for use in the food industry is by an electrolysis process. In an electrolysis process, the coating thickness is very thin and typically ranges between $3.8\times10^{-4}$ to $20.7\times10^{-4}$ mm ($1.5\times10^{-5}$ to $8.15\times10^{-5}$ in.). Furthermore, the equipment and materials needed to properly electroplate the metal materials are very expensive and relatively complex to use. The expense of applying an electroplated-tin coating and the limited obtainable thicknesses of the tin coating are a disadvantage for using such a process for building and roofing materials. A hot-dip process for applying the tin coating may be used; however, if the architectural materials are not properly prepared and the coating is not properly applied to the roofing materials, minute areas of discontinuity in the tin coating may occur resulting in non-uniform corrosion protection. This is especially a problem when the tin is applied to stainless steel materials by a hot-dip process. Tin is not electroprotective to steel under oxidizing conditions. Consequently, discontinuities in the tin coating result in the corrosion of the exposed metal. Tin coatings have the further disadvantage of having a highly-reflective surface. The tin coating is a very stable coating which resists oxidation, thus the highly reflective surface of the tin remains on the coated materials for many years. Even when the tin coating does begin to oxidize, the oxidized coating forms a white texture (tin oxide) and does not turn the color of the popular grey, earth tone color found on weathered terne coatings. As a result, architectural materials coated with a tin coating cannot be used in an environment where highly-reflective materials are undesirable until the coated materials are further treated (i.e. painted) or the tin is allowed time to oxidize.

Coating architectural materials with zinc metal, commonly known as galvanization, is another popular metal treatment to inhibit corrosion. Zinc is a highly desirable metal to coat architectural materials with because of its relatively low cost, ease of application (i.e. hot-dip application) and excellent corrosion resistance. Zinc is also electroprotective to steel under oxidizing conditions and prevents the exposed metal, due to discontinuities in the zinc coating, from corroding. This electrolytic protection extends away from the zinc coating over exposed metal surfaces for a sufficient distance to protect the exposed metal at cut edges, scratches, and other coating discontinuities. With all of the advantages of using zinc, zinc coatings have several disadvantages that make it undesirable for many types of building applications. Although zinc coatings will bond to many types of metals, the formed bond is not strong and can result in the zinc coating flaking off the building materials. Zinc does not bond well on standard stainless steel materials. Zinc also does not form a uniform and/or thick coating in a hot-dip process for stainless steel materials. As a result, discontinuities of the coating are usually found on the stainless steel surface. Zinc is also a very rigid and brittle metal and tends to crack and/or flake off when the building materials are formed on site, i.e. press fitting of roofing materials. When zinc begins to oxidize, the zinc coating forms a white powdery texture (zinc oxide). The popular grey, earth tone color is never obtained from pure zinc coatings.

Due to the various environmental concerns and problems associated with corrosion-resistant coatings applied to metal architectural materials, there has been a demand for a coating which can be easily and successfully applied to materials that protect the materials from corrosion, does not have a highly-reflective surface subsequent to application, can be applied by a standard hot-dipped process, weathers to the popular grey, earth tone color, and allows the materials to be formed at the building site.

SUMMARY OF THE INVENTION

The present invention relates to a corrosion-resistant, environmentally friendly coating formulation for use on architectural materials wherein the coating is environmentally friendly, has a low lead content and weathers to form a non-highly-reflective desirable surface which resembles the grey, earth tone color of weathered terne.

In accordance with the principal feature of the invention, there is provided an architectural material typically of stainless steel, carbon steel or copper coated with a tin-zinc alloy. Other materials can also be coated by the tin-zinc coating such as nickel alloys, aluminum, titanium, bronze, etc. The tin-zinc coating is a multiple phase metal coating mainly comprising zinc and tin. The zinc content of the multiple phase coating is at least 30 weight percent and the tin content is at least 15 weight percent. The tin and zinc content of the tin-zinc alloy makes up at least 80 weight percent of the alloy and preferably makes up at least 90 weight percent of the alloy. The unique tin-zinc combination provides for a corrosion-resistant coating that protects the surface of the architectural material from oxidation, a coating which is environmentally friendly thus immune from the prejudices associated with lead containing materials and a coating which forms a grey, earth tone colored surface which is very similar to weathered terne and which is also not highly reflective. It is new to the art of metal coating to provide a tin-zinc on a stainless steel substrate to form a low lead colored protective coating on the stainless steel.

In accordance with another aspect of the present invention, the tin-zinc coating is applied to the metal roofing materials by a hot-dip process. If the tin-zinc coating is to be applied to stainless steel architectural materials, the coating is preferably applied to the architectural materials by a special process. The special process removes the oxides from the surface of the stainless steel and activates the stainless steel surface so that a strong bond is formed between the stainless steel surface and the tin-zinc coating. "Stainless steel" in the application is defined as a large variety of alloy metals containing chromium and iron. The alloy may also contain other elements such as nickel, carbon, molybdenum, silicon, manganese, titanium, boron, copper, aluminum, nitrogen and various other metals or compounds. Elements such as nickel can be flashed (electroplated) onto the surface of the chromium-iron alloy or directly incorporated into the chromium-iron alloy. The special pretreatment process may also be used to pretreat other architectural material substrates such as carbon steel, copper, titanium, aluminum, bronze and tin to remove oxides from the substrate surface prior to applying the tin-zinc coating. The special pretreatment process includes aggressive picking and chemical activation of the substrate surface.

Prior to aggressive pickling and chemical activation of the substrate, the substrate may be treated with an abrasive and/or absorbent material and/or subjected to a solvent or other type of cleaning solution to remove foreign materials and oxides from the substrate surface.

The aggressive pickling process is designed to remove a very thin surface layer from the substrate surface. The removal of a very thin layer from the surface of the substrate effects the removal of oxides and other foreign matter from the substrate surface thereby activating the substrate surface prior to applying the tin-zinc coating. The activation of a stainless steel substrate is important in order to form a strong bonding and uniformly coated tin-zinc coating. The activation of stainless steel substrates removes the chromium oxide film on the stainless steel which is formed when the stainless steel is passivated by the manufacturer or is formed naturally in the presence of an oxygen containing environment. Testing of stainless steel substrates has revealed that the chromium oxide film interferes with the bonding of the tin-zinc coating and does not allow for thick and/or uniform tin-zinc coatings to be formed. The aggressive pickling process also may slightly etch the substrate surface to remove a very thin layer of the surface. The rate of etching is not the same throughout the surface of the substrate thereby forming microscopic valleys on the substrate surface which increases the surface area for which the tin-zinc coating can bond to the substrate.

The aggressive pickling process includes the use of a pickling solution which removes and/or loosens the oxide from the substrate surface. The pickling solution contains various acids or combinations of acids such as hydrofluoric acid, sulfuric acid, nitric acid, hydrochloric acid, phosphoric acid and/or isobromic acid. A specially formulated pickling solution should be used if the substrate is stainless steel since the activation of a stainless steel surface is not properly accomplished by use of prior art pickling solutions containing only sulfuric acid, nitric acid or hydrochloric acid. The specially formulated pickling solution contains a special combination of hydrochloric acid and nitric acid. This special dual acid formulation was found to be surprisingly effective in the rapid removal of chromium oxide from stainless steel substrates. The dual acid composition of the pickling solution contains 5–25% hydrochloric acid and 1–15% nitric acid and preferably about 10% hydrochloric acid and 3% nitric acid. The temperature of the pickling solution should be controlled to maintain the proper activity of the pickling solution. The temperature of the pickling solution is generally above 80° F. and usually between 120°–140° F. and preferably 128°–133° F.

The pickling solution may be agitated to prevent the solution from stagnating, varying in concentration and/or to remove gas pockets which form on the substrate surface. The substrate may also be scrubbed during the aggressive pickling process to facilitate in the activation of the substrate surface.

Generally, only one pickling vat is needed to properly activate the substrate surface; however, additional pickling vats may be used. The pickling vats are generally twenty-five feet in length; however, the size of the vat may be longer or shorter. The total time for aggressively pickling the substrate is usually less than 10 minutes, typically less than a minute and preferably about 10 to 20 seconds to properly activate a stainless steel substrate. If the substrate is in sheet strip and is to be processed in a continuous process, the pickling vats are usually 25 feet in length and the sheet strip is run through the pickling vats at a rate usually between 1 to 150 feet and typically between 50 to 115 ft/min thereby subjecting the substrate to the pickling solution in each pickling vat for less than one minute. The sheet strip thickness is usually less than 0.1/inch and preferably less than 0.03 inch so that the sheet strip can be properly guided through the continuous process.

Once the substrate has been aggressively pickled, the substrate may further be treated in a chemical activation process. The chemical activation process further removes oxides and foreign material from the substrate by subjecting the substrate surface to a deoxidizing agent. Due to the difficulty in removing oxides from stainless steel substrates, a stainless steel substrate should be treated in the chemical activation process after the stainless steel substrate has been treated in the aggressive pickling process. Various types of deoxidizing solutions can be used. For the treatment of stainless steel substrates, zinc chloride has been found to be an excellent deoxidizing solution.

The zinc chloride acts as both a deoxidizer and a protective coating for the substrate surface. The temperature of the zinc chloride solution is generally kept at ambient temperature(60°–90° F.) and may be agitated to maintain a uniform solution concentration. Small amounts of hydrochloric acid may also be added to the deoxidizing solution to further enhance oxide removal. Preferably, hydrochloric acid is added to the zinc chloride when treating a stainless steel substrate. The time the substrate is subjected to the deoxidizing solution is usually less than 10 minutes. If the substrate is in sheet strip form and is being processed in a continuous process, the deoxidization solution tanks are usually 25 feet in length thereby subjecting the substrate to the deoxidation solution for less than one minute.

The special pretreatment process may also include the maintaining of a low oxygen environment prior to and/or subsequent to subjecting the substrate to the aggressive pickling process and/or chemical activation process. The maintenance of a low oxygen environment inhibits the formation and/or reformation of oxides on the substrate surface. The low oxygen environment may take on several forms. Two examples of low oxygen environments are the formation of a low oxygen-containing gas environment about the substrate or the immersion of the substrate in a low oxygen-containing liquid environment. Both these environments act as shields against atmospheric oxygen and prevent and/or inhibit oxides from forming. If the substrate is stainless steel, the low oxygen environment should be maintained throughout the pretreatment process of the stainless steel substrate to just prior to the coating of the substrate with the tin-zinc coating. The non-oxidized surface of a stainless steel substrate is highly susceptible to rapid reoxidation when in contact with oxygen. By creating a low oxygen environment about the stainless steel strip, new oxide formation is inhibited and/or prevented.

Examples of low oxygen gas environments include nitrogen, hydrocarbons, hydrogen, noble gasses and/or other non-oxidizing gasses. Generally, nitrogen gas is used to form the low oxygen gas environment. Examples of low oxygen liquid environment include non-oxidizing liquids and/or liquids containing a low dissolved oxygen content. An example of the latter is heated water sprayed on the surfaces of the substrate; however, the substrate may also be immersed in the heated water. Heated water contains very low levels of dissolved oxygen and acts as a shield against oxygen from forming oxides with the substrate. The spray action of the heated water may also be used to remove any remaining pickling solution or deoxidizing solution from the substrate. Generally, the temperature of the heated water is maintained above 100° F. and typically about 110° F. or greater so as to exclude the unwanted dissolved oxygen.

In accordance with yet another aspect of the present invention, the tin-zinc coating is applied to the substrate by a hot-dip process. The hot-dip process is designed to be used in a batch or a continuous process. The substrate is coated in the hot-dip process by passing the substrate through a coating vat which contains the special tin-zinc formulation. The coating vat may include a flux box whereby the substrate passes through the flux box and into the molten tin-zinc formulation. The flux box typically contains a flux which has a lower specific gravity than the molten tin-zinc, thus the flux floats on the surface of the molten tin-zinc. The flux within the flux box acts as the final surface treatment of the substrate. The flux removes residual oxides from the substrate surface and shields the substrate surface from oxygen until the substrate is coated with the tin-zinc alloy. The flux preferably contains zinc chloride and may contain ammonium chloride. The flux solution typically contains approximately 30–60 weight percent zinc chloride and up to about 40 weight percent ammonium chloride and preferably 50% zinc chloride and 8% ammonium chloride; however, the concentrations of the two flux agents may be varied accordingly.

Once the substrate passes through the flux, the substrate enters the molten tin-zinc formulation. The temperature of the molten tin-zinc can range from 449° F. to over 800° F. The tin-zinc alloy must be maintained above its melting point or improper coating will occur. Tin melts at 232° C. (450° F.) and lead melts at 328° C. (622° F). Zinc melts at 420° C. (788° F.). The larger the content of zinc, the closer the melting point of the tin-zinc coating approaches 420° C. In order to accommodate for the temperatures, the coating vat may have to be made of a material which can withstand the higher temperatures. The palm oil that is located on the surface of the molten tin-zinc in the coating vat degrades at temperatures above about 650° F., thus special oils and/or special cooling procedures for the palm oil will have to be employed for high zinc content alloys. A zinc content of the coating which does not exceed 65 weight percent has a low enough melting point temperature that does not require a modified coating vat and can use palm oil.

The time period for applying a tin-zinc coating to the substrate is usually less than 10 minutes. If the substrate is in sheet strip form and is being processed in a continuous process, the time period for applying the tin-zinc coating is typically less than two minutes and usually from 10 to 30 seconds. After the substrate has been coated, the coated substrate is usually cooled. The cooling of the coated substrate can be accomplished by spraying a cool fluid such as ambient temperature water and/or immersing the coated substrate in a cooling liquid such as ambient temperature water. The cooling of the coated substrate usually is less than one hour and preferably is less than two minutes.

The thickness of the tin-zinc coating is usually regulated by coating rollers. The thickness of the tin-zinc coating is usually from 0.0001–0.05 inch. Spray jets which spray the tin-zinc alloy onto the substrate may be used to ensure a uniform and continuous coating on the substrate.

In accordance with another aspect of the invention, nickel may be added to the tin-zinc coating. Nickel has been found to provide additional corrosion protection.

In accordance with another aspect of the invention, bismuth and antimony may be added to the tin-zinc coating to inhibit the crystallization of the tin in cold weather. When tin crystallizes, the bonding of the tin-zinc coating to the roofing materials may weaken resulting in flaking of the coating. The addition of small amounts of bismuth and/or antimony at least as low as 0.05 weight percent has been found to prevent and/or inhibit the such crystallization of the tin. The addition of a metallic stabilizer may also help reduce the dross formation during the coating process. Bismuth or zinc may be added in larger quantities to also enhance the hardness and strength of the tin-zinc coating to increase the resistance to wear of the coating.

In accordance with another feature of the present invention, the tin-zinc coating is essentially lead free. The lead content is maintained at extremely low levels not exceeding 0.05 weight percent. Preferably, the lead content is maintained at much lower weight percentage levels so as to dispense with any environmental concerns associated with the tin-zinc coating.

In accordance with yet another feature of the present invention, the tin-zinc coating composition is such that the coating provides excellent corrosion resistance and the coated materials can be formed on site without the tin-zinc coating cracking and/or flaking off. The amount of zinc in the tin-zinc coating is controlled such that the coating does not become too rigid and brittle.

In accordance with still another aspect of the present invention, the metallic roofing materials are plated with a nickel barrier prior to applying the tin-zinc coating to provide additional corrosion resistance, especially against halogens such as chlorine. The nickel barrier is applied to the metal building materials at a thin layer. Although the tin-zinc coating provides excellent protection against most of these corrosion-producing elements and compounds, compounds such as chlorine have the ability to eventually penetrate the tin-zinc coating and attack and oxidize the surface of the metallic building materials thereby weakening the bond between the roofing material and the tin-zinc coating. The nickel barrier has been found to provide an almost impenetrable barrier to these elements and/or compounds which in fact penetrate the tin-zinc coating. Due to the very small amount of these compounds penetrating the tin-zinc coating, the thickness of the nickel barrier can be maintained at thin thicknesses while still maintaining the ability to prevent these components from attacking the metal roofing material. The tin-zinc coating and thin nickel coating effectively complement one another to provide superior corrosion resistance.

In accordance with another feature of the present invention, nickel may be added to the coating in amounts up to 5 weight percent and preferably less than 1 weight percent to increase the corrosion resistance of the tin-zinc alloy.

In accordance with still another feature of the present invention, copper may be added to the tin-zinc alloy as a coloring agent. Up to 5 weight percent copper can be added to the tin-zinc alloy. Typically, 2.0 weight percent or less copper is added to the tin-zinc alloy. The addition of copper dulls the color of the tin-zinc alloy thereby making the alloy less reflective.

The primary object of the present invention is the provision of an architectural material coated with a metallic coating which is highly corrosive resistant.

Another object of the present invention is the provision of an architectural material treated with a metallic coating that is not highly reflective.

Still another object of the present invention is the provision of coating a metal sheet with a tin-zinc coating containing nickel.

Yet another object of the present invention is a metallic coating, as defined above, which is a multiple phase system comprised of tin and zinc.

Still another object of the present invention is the provision of a tin-zinc coating which weathers to a grey, earth tone color.

Yet another object of the present invention is the provision of an architectural material having a tin-zinc metallic coating which is essentially lead free.

Still yet another object of the present invention is to provide a multiple phase, tin-zinc metallic coating applied to a base metal sheet which coated sheet can be formed and sheared to form various building and roofing components that can be subsequently assembled on site without the metallic coating flaking off, chipping, and/or cracking.

Still another object of the present invention is the provision of providing a tin-zinc coated roofing material which can be preformed into roof pans and subsequently seamed on site either by pressed seams or soldered seams into waterproof joints.

Another object of the present invention is the provision of applying a thin nickel barrier to the surface of the architectural material prior to applying the tin-zinc coating.

Yet another object of the present invention is the provision of coating an architectural material by a hot-dipped process.

Still yet another object of the present invention is the addition of nickel to the tin-zinc alloy to increase the corrosion resistance of the alloy.

Another object of the present invention is the addition of a coloring agent to the tin-zinc alloy to dull the color of the alloy.

These and other objects and advantages will become apparent to those skilled in the art upon reading of the detailed description of the invention set forth below.

DESCRIPTION OF THE PREFERRED EMBODIMENT

The tin-zinc coating is a multiple phase metallic coating which, when applied to stainless steel, carbon steel or copper materials, forms a highly corrosion-resistant coating that reduces the corrosion of the materials when exposed to the atmosphere. The tin-zinc coating contains a large weight percentage of zinc and tin. It has been discovered that by adding zinc in the amounts of at least 30 weight percent and the tin at least 15 weight percent of the tin-zinc alloy, wherein the tin plus zinc content of the tin-zinc alloy is at least 80 weight percent, the corrosion resistance of the multiple phase metallic coating is significantly increased as compared to a protective coating essentially composed of tin. Preferably, the tin plus zinc content of the alloy is at least 90 weight percent and can make up about 100 weight percent of the alloy. Although the exact reasons for this physical phenomenon of increased corrosion resistance due to the addition of zinc to tin is unknown to the inventors, it has been found that by adding zinc to tin, the multiple phase metallic coating exhibits corrosive-resistant properties which exceed that of tin coatings and, in some environments, that of a terne coating.

The tin-zinc coating is electroprotective under oxidizing conditions which inhibits oxidation of exposed metal near the tin-zinc coating. As a result, minor discontinuities in the tin-zinc coating do not result in oxidation of the exposed metal, a contrary result if only a tin coating is used.

The tin-zinc coating may contain small amounts of other metals to modify the physical properties of the tin-zinc, multiple phase metallic coating; however, these metal components contribute primarily to the coloring of the coating and to the corrosion-resistant properties of the coating.

The tin-zinc coating can be applied to stainless steel, carbon steel and copper materials by preferably using a conventional hot-dipping process; however, the coating may be applied by other means. The tin-zinc coating is not limited to only the protection of stainless steel, carbon steel and copper and may also be applied to other metals such as bronze, tin, aluminum, titanium, etc.

The large zinc content of the multiple phase metallic tin-zinc coating has not been previously used, especially on architectural materials such as metallic building and roofing materials. The bonding of the tin-zinc coating to carbon steel and stainless steel roofing materials is surprisingly strong and forms a durable protective coating which is not easily removable, thereby resisting flaking of the coating. The surfaces of the metallic roofing and building materials may be pretreated prior to the coating to improve the bonding between the tin-zinc coating and the surface of the metallic roofing material. For stainless steel materials, a special pretreatment process should be used which includes aggressively pickling and chemically activating the surface of the stainless steel to activate the stainless steel surface to provide significantly greater bonding of the tin-zinc coating.

The life of the architectural material is significantly extended by coating the material with the tin-zinc metallic coating. The tin-zinc coating acts as a barrier to the atmosphere which prevents the metallic coating from oxidizing and/or reducing in the presence of oxygen, carbon dioxide or other reducing agents in the environment. Although the tin-zinc coating oxidizes in the presence of various reducing agents in the atmosphere, the rate of oxidation is significantly slower than that of the architectural materials. Furthermore, the tin and zinc oxide which forms on the coating surface provides corrosion resistance to the tin-zinc coating itself which further enhances the corrosion protection provided by the tin-zinc coating.

The tin-zinc oxides also reduce the reflectivity of the tin-zinc coating and color the tin-zinc coating. Terne coated materials have become very popular since terne coated materials eventually weather and turn a grey, earth tone color. The inventors discovered that the novel tin-zinc formulations forms a colored coating which closely matches the popular grey, earth tone color of weathered terne. Furthermore, by coating the building materials with the tin-zinc coating, the usable life of the materials usually extend beyond the life of the structure due to the corrosion-resistance of the tin-zinc coating.

The tin-zinc coating is primarily composed of tin and zinc and contains little, if any, lead thus making the coating essentially lead free and environmentally friendly. The lead content, if any, is maintained at extremely low levels within the metallic coating. The amount of lead in the tin-zinc coating is maintained such that no more than 0.05 weight percent is present in the coating. Preferably, the lead content in the coating is maintained at levels less than 0.01 weight percent. The limiting of lead content in the metallic coating eliminates any concerns associated with the leaching of the lead from the metallic coating and the environmental concerns associated with products containing lead.

The tin-zinc metallic coating is a multiple phase system which contains a large weight percentage of zinc and tin. Preferably, the zinc weight percentage is at least 30% and can be as much as 85% of the tin-zinc coating. Preferably, the zinc content of the alloy is 30–65%. Tin-zinc coating containing 45–55% zinc have formed highly desirable coatings. The tin content within the metallic coating essentially makes up the balance of the metallic coating. The tin content ranges between 15–70 weight percent of the tin-zinc metallic coating. The tin plus zinc content of the tin-zinc coating is preferably at least 90 weight percent and alloys containing at least 95 weight percent are highly preferable.

The tin-zinc system forms a multiple phase metallic coating. A multiple phase system is defined as a metal alloy comprising at least two primary components. Surprisingly, the inventors have found that the tin-zinc coating provides a protective coating with a higher corrosion resistance as compared to a tin coating primarily made up of tin. The amount of zinc within the metallic coating is maintained so as not to exceed 85% so that the metallic coating remains relatively pliable for use in a press-fit roofing system and can be applied by standard hot-dipped processes.

The inventors have discovered that the use of large weight percentages of zinc in the tin-zinc alloy does not cause the coating to be too rigid or brittle thus preventing the coated material to be formed or bent which results in a cracked coating. Extensive experimentation by the inventors was performed on tin-zinc coatings having a zinc content above 30 weight percent. Surprisingly, the inventors discovered that a tin-zinc coating containing 30–85 weight percent zinc and essentially the balance tin produced a malleable metallic coating which resisted cracking when bent or formed. The inventors believe that the unique characteristics of the multiple phase metallic tin-zinc system modifies the rigid characteristics of zinc to allow the tin-zinc coating to be malleable. In addition to the surprising malleability of the tin-zinc coating, the inventors discovered that the coating provides comparable and/or superior corrosion resistance to tin, zinc or terne coatings.

The inventors also discovered that the tin-zinc coating containing 30–85 weight percent zinc produced a colored coating which closely matched the popular gray, earth tone color of weathered terne. This color has become very popular with consumers; however, the color has been almost impossible until now to match unless the material was painted. The inventors have discovered that the high zinc tin-zinc coating changes to a color which very closely resembles the popular grey, earth tone color.

The inventors have found that tin-zinc coatings containing 30–65 weight percent zinc could be coated in standard hot-dipped coating facilities without the need to use a special molten vat that could withstand higher temperatures. Tin-zinc coatings which contain more zinc, about 65% to 85%, melt at a higher temperature and may require minor modifications to a standard hot-dipped process.

The tin-zinc coating may contain nickel to increase the corrosion resistance of the coating. The nickel in the coating has been found to increase the corrosion resistance of the tin-zinc coating especially in alcohol and halogen containing environments. The nickel content of the tin-zinc coating preferably does not exceed 5.0 weight percent. Larger nickel concentrations can make the coated materials difficult to form. Typically, the nickel content is less than 1.0 weight percent such as from 0.3–0.9 weight percent and preferably about 0.7 weight percent.

A coloring agent may be added to the tin-zinc alloy to affect the color and reflectivity of the coated substrate. Copper metal has been found to be an effective coloring agent to reduce the reflectiveness of the newly applied tin-zinc coating by dulling the color of the tin-zinc coating. The copper content can be added up to 5 weight percent of the multiple-phase tin-zinc alloy. If copper is added, copper is usually added in amounts from 0.1 to 1.6 weight percent and preferably from 1.0 to 1.5 weight percent.

The tin-zinc metallic coating may also contain other metallic components which can be used to slightly modify the physical properties of the metallic coating. The metallic coating may contain bismuth and antimony to increase the strength of the metallic coating and also to inhibit the crystallization of the tin at lower temperatures. The amount of bismuth in the metallic coating may range between 0–1.7 weight percent and the amount of antimony may range between 0–7.5 weight percent of the coating. Antimony and/or bismuth can be added to the metallic coating in amounts as low as 0.05 weight percent of the coating and the low amount has been found sufficient to prevent the tin from crystallizing at low temperatures which may result in the metallic coating flaking off the metallic roofing materials. It is believed that the high levels of zinc also help stabilize the tin within the coating. Thus, the antimony and/or bismuth amount may be present in amounts lower than 0.05 weight percent and still help prevent crystallization of the tin. Antimony and/or bismuth in weight percentages greater than 0.5% are primarily added to harden and/or strengthen the metallic coating. Small amounts of other metals such as iron may be added to the metallic coating. If iron is added to the tin-zinc metallic coating, preferably the iron content is not more than 0.1 weight percent.

The tin-zinc coating forms a grey, earth tone color which closely resembles the color associated with weathered terne coatings. The grey surface is much less reflective than that of coatings of tin and/or non-weathered terne. The reduced reflective surface of the tin-zinc coating is important in that the coated building materials can be immediately used on facilities that require materials not to be highly reflective. Prior coatings such as tin and/or terne had to be weathered and/or additionally treated before such coated building materials could be used on facilities which prohibit the use of highly-reflective materials. The tin-zinc alloy weathers much quicker than terne coatings or tin coatings.

The tin-zinc coating can be applied to many types of metals. The three most popular metals are carbon steel, stainless steel and copper. These three metals are preferably pre-treated before coating to clean the material surface and remove oxides from the surface so that a strong bond is formed between the material and the tin-zinc coating.

The inventors also have discovered that if the architectural material is plated with a thin nickel layer prior to coating the material with the tin-zinc coating, the material may exhibit improved corrosion resistance in acidic and/or hologynic environments. If a nickel layer is to be applied, the nickel layer is preferably plated to the metallic building material by an electrolysis process. The thickness of the layer is maintained such that it preferably is not more than 3 microns ($1.18\times10^{-4}$ in) thick and preferably has a thickness which ranges between 1–3 microns. The bond between the tin-zinc coating and the nickel layer is surprisingly strong and durable and thereby inhibits the tin-zinc coating from flaking especially when the building materials are preformed or formed during installation. The plating of the building materials with the nickel layer is very desirable when the building materials are used in an environment which has high concentrations of fluorine, chlorine and other halogens. Although the tin-zinc coating significantly reduces the corrosive effects of halogens on the metallic building materials, the inventors have found that by placing a thin layer of plated nickel between the metallic building material and the tin-zinc coating, the corrosive effects of the halogens are even further reduced.

The general formulation of the invention is as follows:

| | |
|---|---|
| Tin | 15–70 |
| Zinc | 30–85 |
| Nickel | ≦5.0 |
| Antimony | ≦7.5 |
| Bismuth | ≦1.7 |
| Copper | ≦[2.0] 5 |
| Iron | ≦0.1 |
| Lead | <0.05 |

A few examples of the tin-zinc, two-phase metallic coating which have exhibited the desired characteristics as mentioned above are set forth as follows:

| Alloy Ingredients | A | B | c | D | E |
|---|---|---|---|---|---|
| Tin | 15 | 30 | 35 | 45 | 50 |
| Nickel | ≦1.0 | ≦1.0 | ≦1.0 | ≦1.0 | ≦1.0 |
| Antimony | ≦0.5 | ≦0.5 | ≦0.5 | ≦0.5 | ≦0.5 |
| Bismuth | ≦0.5 | ≦0.5 | ≦0.5 | ≦0.5 | ≦0.5 |
| Copper | ≦2.0 | ≦2.0 | ≦2.0 | ≦2.0 | ≦2.0 |
| Iron | ≦0.1 | ≦0.1 | ≦0.1 | ≦0.1 | ≦0.1 |
| Lead | ≦0.01 | ≦0.01 | ≦0.01 | ≦0.01 | ≦0.01 |
| Zinc | Bal. | Bal. | Bal. | Bal. | Bal. |

| Alloy Ingredients | F | G | H |
|---|---|---|---|
| Tin | 55 | 60 | 70 |
| Nickel | ≦1.0 | ≦1.0 | ≦1.0 |
| Antimony | ≦0.5 | ≦0.5 | ≦0.5 |
| Bismuth | ≦0.5 | ≦0.5 | ≦0.5 |

-continued

| | | | |
|---|---|---|---|
| Copper | ≦2.0 | ≦2.0 | ≦2.0 |
| Iron | ≦0.1 | ≦0.1 | ≦0.1 |
| Lead | ≦0.01 | ≦0.01 | ≦0.01 |
| Zinc | Bal. | Bal. | Bal. |

Preferably, the formulation of the tin-zinc metallic coating includes in weight percentage amounts: 30–65% zinc, 0–0.5% antimony, 0–0.5% bismuth, 35–70% tin, up to 1.0% nickel, 0.0–2.0% copper and less than 0.05 lead and more preferably 45–55% zinc, 45–55% tin, 0.3–0.9% nickel, 0.0–0.5% bismuth and/or antimony, 1.0–1.5% copper, less than 0.01% lead and the tin content plus zinc content exceeds 95% of the coating.

The thickness of the tin-zinc coating may be varied depending upon the environment in which the architectural materials are to be used. The tin-zinc coating exhibits superior corrosive-resistant properties as compared to tin coatings. The metallic coating may be applied in a thickness between 0.0001–0.05 in. Preferably, the coating thickness is applied by a hot-dip process and ranges between 0.001–0.002 in. Such a coating thickness has been found to be adequate to prevent and/or significantly reduce the corrosion of the metallic architectural materials in virtually all types of environments. Coatings having thicknesses greater than 0.002 can be used in harsh environments to provide added corrosion protection.

The tin-zinc coating can be welded with standard lead solders and no-lead solders. Preferably, no-lead solders are used to avoid concerns associated with the use of lead.

The invention has been described with reference to the preferred and alternate embodiments. Modifications and alterations will become apparent to those skilled in the art upon the reading and understanding of the details discussed in the detailed discussion of the invention provided for herein. This invention is intended to include all such modifications and alterations insofar as they come within the scope of the present invention.

Having defined the invention, the following is claimed:

1. A coated metal material coated with a low-reflecting, highly corrosive-resistant, two-phase tin-zinc metallic alloy coating, said coating comprising at least 0.3 weight percent nickel, at least 0.05 weight percent metallic stabilizer selected from the group consisting of antimony and bismuth, at least 15 weight percent tin and at least 30 weight percent zinc wherein said tin content plus said zinc content exceeds 80 weight percent of said coating.

2. A coated metal material as defined in claim 1, wherein said nickel content is 0.3–0.9 weight percent.

3. A coated metal material as defined in claim 2, wherein said nickel content is 0.7 weight percent.

4. A coated metal material as defined in claim 1, wherein said zinc is 30–65 percent by weight.

5. A coated metal material as defined in claim 4, wherein said zinc content is 40–60 weight percent.

6. A coated metal material as defined in claim 1, wherein said coating includes lead in an amount less than 0.01 percent by weight.

7. A coated metal material as in claim 1, wherein said metal coating comprises:

| | |
|---|---|
| Tin | 15.0–70.0% |
| Zinc | 30.0–85.0% |
| Bismuth | 0.0–1.7% |
| Antimony | 0.0–7.5% |
| Copper | 0.0–5.0% |
| Iron | 0.0–0.1% |
| Lead | 0.0–0.05% |
| Nickel | 0.3–5.0% |

8. A coated metal material as defined in claim 1, wherein said metal material is carbon steel.

9. A coated metal material as defined in claim 1, wherein said metal material is stainless steel.

10. A coated metal material as defined in claim 1, wherein said metal material is copper.

11. A coated metal material as defined in claim 1, wherein the surface of said metal material is plated with a thin nickel layer prior to applying said metallic coating.

12. A coated metal material as defined in claim 11, wherein said nickel layer thickness up to three microns.

13. A coated metal material as defined in claim 12, wherein said nickel layer is electroplated onto said metal material.

14. A coated metal material as defined in claim 1, wherein said tin content plus zinc content exceeds 90 weight percent.

15. A coated metal material as defined in claim 1, wherein said tin content plus zinc content exceeds 95 weight percent.

16. A coated metal material formed of a carbon steel or stainless steel sheet metal roofing material coated with a low-reflecting, highly corrosion-resistant, two phase, tin-zinc metallic coating, said sheet metal including a nickel barrier between said metallic coating and said steel sheet, said metal coating comprising tin, zinc, nickel and at least 0.05 weight percent metal stabilizer selected from the group consisting of antimony and bismuth such that the coating includes:

| | |
|---|---|
| Tin | 15.0–70.0% |
| Zinc | 30.0–85.0% |
| Bismuth | 0.0–1.7% |
| Antimony | 0.0–7.5% |
| Iron | 0.0–0.1% |
| Lead | 0.0–0.05% |
| Nickel | 0.3–1.0% |
| Copper | 0.0–2.0% |

17. A coated metal material as defined in claim 16, wherein said zinc content is 40–60 weight percent.

18. A coated metal material as defined in claim 16, wherein said zinc content is 45–55 weight percent.

19. A coated metal material as defined in claim 16, wherein the tin content plus zinc content exceeds 95 weight percent.

20. A coated metal material as defined in claim 16, wherein said lead content is less than 0.01 weight percent.

21. A coated metal material as defined in claim 16, wherein said nickel content is 0.3–0.9 weight percent.

22. A coated metal material as defined in claim 21, wherein said nickel content is 0.7 weight percent.

23. A coated metal material as defined in claim 16, wherein the metal content of said material, excluding tin, zinc and nickel, is not more than 2.0 weight percent.

24. A coated metal material as defined in claim 23, wherein the metal content of said material, excluding tin, zinc and nickel, is not more than 1.0 weight percent.

25. A coated metal material as defined in claim 16, wherein said nickel barrier is up to 3 microns thick.

26. A coated metal material coated with a low-reflecting, highly corrosion-resistant, multiple phase tin-zinc metallic coating, said coating comprising of at least about 0.1 weight percent copper, at least 15 weight percent tin wherein said tin content plus the zinc content exceeds 80 weight percent of said coating.

27. A coated metal material as defined in claim 26, wherein said coating includes nickel.

28. A coated metal material as defined in claim 27, wherein said nickel content is 0.3–5.0 weight percent of said coating.

29. A coated metal material as defined in claim 28, wherein said metal coating comprises:

| | |
|---|---|
| Tin | 15.0–70.0% |
| Zinc | 30.0–85.0% |
| Copper | 0.1–5.0% |
| Nickel | 0.3–5.0% |

30. A coated metal material as defined in claim 29, wherein said metal coating comprises:

| | |
|---|---|
| Tin | 35.0–[75.0] 70.0% |
| Zinc | 30.0–65.0% |
| Copper | 0.1–2.0% |
| Nickel | [0.0] 0.3–1.0% |

31. A coated metal material as defined in claim 30, wherein said metal coating comprises:

| | |
|---|---|
| Tin | 35.0–70.0% |
| Zinc | 30.0–65.0% |
| Copper | 0.1–1.5% |
| Nickel | 0.3–0.9% |

32. A coated metal material as defined in claim 26, wherein said copper content is about 0.1–5.0 weight percent of said coating.

33. A coated metal material as defined in claim 32, wherein said copper content is about 0.1–1.6 weight percent of said coating.

34. A coated metal material as defined in claim 33, wherein said copper content is about 1.0–1.5 weight percent of said coating.

35. A coated metal material as defined in claim 32, wherein said coating includes nickel an said nickel content is 0.3–5.0 weight percent of said coating.

36. A coated metal material coated with a low-reflecting, highly corrosive-resistent, two-phase tin-zinc metallic alloy by continuously passing said metal material through a bath of molten metal, said metallic alloy comprising zinc, at least 15 weight percent tin and at least 0.1 weight percent copper.

37. A coated metal material coated with a low reflecting, highly corrosive-resistent, two-phase tin-zinc metallic alloy by continuously passing said metal material through a bath of molten metal, said metallic alloy comprising zinc, nickel, at least 15 weight percent tin, and at least 0.05 weight percent metallic stabilizer selected from the group consisting of antimony, bismuth and copper.

* * * * *

UNITED STATES PATENT AND TRADEMARK OFFICE

CERTIFICATE OF CORRECTION

PATENT NO. : 5,429,882
DATED : July 4, 1995
INVENTOR(S) : Carey, II et al.

It is certified that error appears in the above-identified patent and that said Letters Patent is hereby corrected as shown below:

Title page,
Item [63], change the date of "March 10" to -- March 14 --.

Column 1,
Line 5, change "Mar. 10, 1994" to -- Mar. 14, 1994 --.

Signed and Sealed this

Thirtieth Day of July, 2002

*Attest:*

*Attesting Officer*

JAMES E. ROGAN
*Director of the United States Patent and Trademark Office*